US009387360B2

(12) United States Patent
Niederman

(10) Patent No.: US 9,387,360 B2
(45) Date of Patent: Jul. 12, 2016

(54) WRIST AND FOREARM STRENGTHENING DEVICE

(71) Applicant: Justin Niederman, Medina, MN (US)

(72) Inventor: Justin Niederman, Medina, MN (US)

( * ) Notice: Subject to any disclaimer, the term of this patent is extended or adjusted under 35 U.S.C. 154(b) by 117 days.

(21) Appl. No.: 13/841,782

(22) Filed: Mar. 15, 2013

(65) Prior Publication Data

US 2013/0331234 A1 Dec. 12, 2013

Related U.S. Application Data

(60) Provisional application No. 61/658,252, filed on Jun. 11, 2012.

(51) Int. Cl.

| | |
|---|---|
| ***A63B 23/14*** | (2006.01) |
| ***A63B 21/012*** | (2006.01) |
| ***A63B 15/00*** | (2006.01) |
| ***A63B 21/00*** | (2006.01) |
| ***A63B 21/015*** | (2006.01) |
| ***A63B 23/035*** | (2006.01) |
| *A63B 21/06* | (2006.01) |
| *A63B 21/008* | (2006.01) |

(52) U.S. Cl.

CPC ..... *A63B 23/14* (2013.01); *A63B 15/00* (2013.01); *A63B 21/0004* (2013.01); *A63B 21/0005* (2013.01); *A63B 21/00069* (2013.01); *A63B 21/015* (2013.01); *A63B 21/4035* (2015.10); *A63B 21/4049* (2015.10); *A63B 23/03533* (2013.01); *A63B 21/008* (2013.01); *A63B 21/0602* (2013.01); *A63B 21/0603* (2013.01); *A63B 2102/02* (2015.10); *A63B 2102/14* (2015.10); *A63B 2102/18* (2015.10); *A63B 2102/22* (2015.10); *A63B 2102/32* (2015.10)

(58) Field of Classification Search

CPC .. A63B 21/02; A63B 21/072; A63B 21/0724; A63B 21/0726; A63B 23/12; A63B 23/14; A63B 23/16; A63B 23/035; A63B 23/03516; A63B 21/012; A63B 21/0125; A63B 21/015; A63B 21/018

USPC ..... 482/44–50, 92–93, 106–108, 114–115, 482/118, 121, 127–128

See application file for complete search history.

(56) References Cited

U.S. PATENT DOCUMENTS

| | | | | | |
|---|---|---|---|---|---|
| 3,132,861 | A * | 5/1964 | Horney | A63B 21/0004 | 482/128 |
| 3,184,234 | A * | 5/1965 | Struble | A63B 23/14 | 473/280 |
| 3,211,453 | A * | 10/1965 | Williams | A63B 23/14 | 482/119 |
| 4,039,183 | A | 8/1977 | Sakurada | | |
| 4,203,591 | A | 5/1980 | Gibson | | |
| 4,379,552 | A | 4/1983 | Webb et al. | | |
| 4,591,151 | A | 5/1986 | Hensley | | |
| 4,695,049 | A * | 9/1987 | Ciemiega | A63B 23/14 | 482/115 |
| 4,838,542 | A * | 6/1989 | Wilkinson | A63B 23/14 | 482/108 |
| 4,869,491 | A | 9/1989 | Nolan | | |
| 4,913,417 | A | 4/1990 | Francu | | |
| 5,046,727 | A * | 9/1991 | Wilkinson | A63B 21/00043 | 428/909 |
| 5,080,349 | A * | 1/1992 | Vittone | A63B 23/14 | 482/106 |
| 5,244,442 | A * | 9/1993 | Schill | A63B 21/015 | 482/114 |

(Continued)

*Primary Examiner* — Oren Ginsberg
*Assistant Examiner* — Garrett Atkinson
(74) *Attorney, Agent, or Firm* — Lathrop & Gage LLP

(57) ABSTRACT

Embodiments of the present disclosure provide a wrist strengthening device having a first handle, a second handle and a tightening mechanism for increasing the resistance between the first handle, the second handle and the tightening mechanism.

8 Claims, 6 Drawing Sheets

400

(56) References Cited

U.S. PATENT DOCUMENTS 5,312,308 A * 5/1994 Hamilton ..... A63B 21/072 473/256
5,380,261 A 1/1995 Mora
5,399,135 A 3/1995 Azzouni
5,547,441 A 8/1996 Mora
5,634,871 A * 6/1997 Froelich, Sr. ..... A63B 21/015 482/118
5,776,034 A 7/1998 Stamler
6,071,214 A * 6/2000 Osterman ..... A63B 23/14 482/44
6,152,858 A * 11/2000 Kolb ..... A63B 23/14 482/100
7,094,182 B1 8/2006 Holten
2006/0172872 A1* 8/2006 Nasir ..... A63B 21/05 482/106
2009/0093319 A1* 4/2009 Omidi ..... A63B 69/3632 473/219
2010/0160119 A1 6/2010 O'Connor et al.
2010/0267523 A1* 10/2010 Wilkinson ..... A63B 21/00069 482/45

* cited by examiner

400

WRIST AND FOREARM STRENGTHENING DEVICE

CROSS-REFERENCE TO RELATED APPLICATIONS

The present application claims priority to U.S. Provisional Application No. 61/658,252 filed on Jun. 11, 2012 entitled Wrist and Forearm Strengthening Device, the aforementioned application being incorporated by reference in its entirety.

BACKGROUND

For certain activities, wrist strength may affect the performance of an individual. For example, in sports such as golf, baseball or tennis, wrist strength and/or forearm strength may affect the velocity with which the ball may be driven. Likewise, in basketball wrist and forearm strength may affect the range at which a player may shoot the ball. Similarly, in gymnastics, wrist strength may affect the overall performance of the gymnast. Typical wrist exercises include the use of dumbbells or wrist rollers. However, these devices are often cumbersome and may be inaccessible to the general public.

BRIEF SUMMARY

This summary is provided to introduce a selection of concepts in a simplified form that are further described below in the Detailed Description section. This summary is not intended to identify key features or essential features of the claimed subject matter, nor is it intended to be used as an aid in determining the scope of the claimed subject matter.

Embodiments of the present disclosure provide a wrist strengthening device having a first handle, a second handle and a tightening mechanism for increasing the friction between the first handle, the second handle and the tightening mechanism. Other embodiments described herein include a wrist strengthening device comprising a first handle, a second handle that is coupled to the first handle, and a mechanism having at least one conical component. In such an embodiment, the conical component is configured to increase friction between the first handle and the second handle as the first handle is moved in a first direction and as the second handle is simultaneously moved in a second direction that is opposite from the first direction. In still yet other embodiments, a wrist strengthening device is provided having a first handle, a second handle and a planetary gearbox configured to move a liquid in response to a rotation of either the first handle or the second handle.

BRIEF DESCRIPTION OF THE DRAWINGS

Further features, aspects, and advantages will become better understood by reference to the following detailed description, appended claims, and accompanying figures, wherein elements are not to scale so as to more clearly show the details, wherein like reference numbers indicate like elements throughout the several views, and wherein:

DETAILED DESCRIPTION

Various embodiments are described more fully below with reference to the accompanying drawings, which form a part hereof, and which show specific exemplary embodiments. However, embodiments may be implemented in many different forms and should not be construed as limited to the embodiments set forth herein; rather, these embodiments are provided so that this disclosure will be thorough and complete, and will fully convey the scope of the embodiments to those skilled in the art. The following detailed description is, therefore, not to be taken in a limiting sense.

Figure 1A:
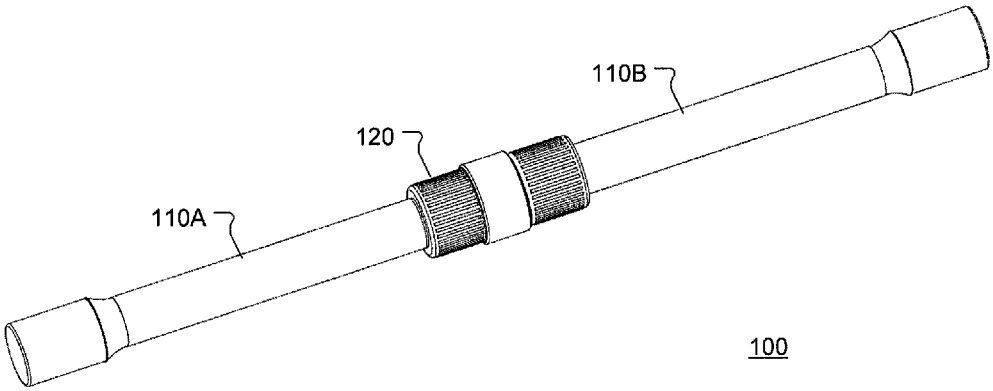
FIGS. 1A and 1B illustrate a wrist strengthening device according to a first embodiment of the present disclosure.
Figure 1B:
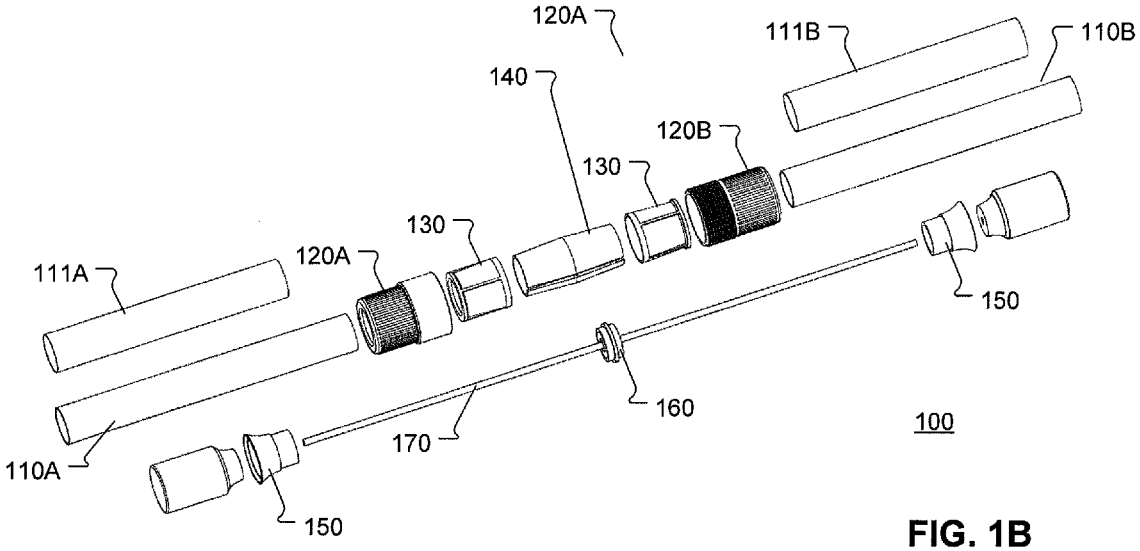

FIGS. 1A-1B illustrate a wrist strengthening device 100 according to an embodiment of the present disclosure. Specifically, FIG. 1A illustrates an isometric view of the wrist strengthening device 100 and FIG. 1B illustrates an exploded isometric view of the wrist strengthening device 100. As shown in each of FIGS. 1A and 1B below, the wrist strengthening device 100 is springless. The embodiments disclosed herein rely on friction to create a resistance that may be used to strengthen the wrists and/or forearms of a user. For example, as the handles of the wrist strengthening device 100 are twisted in opposite directions, friction is created and as the amount of friction increases, the user is required to exert an increased amount of force, which in turn, strengthens the user's wrists and/or forearms. In an embodiment, one or more components of the device 100 may be configured to increase resistance of one handle without increasing the resistance of the other.

In certain embodiments, the wrist strengthening device 100 includes two handles 110A and 110B which are joined together via a centerpiece 120. Each of the handles 110A and 110B are configured to rotate in opposite directions. Thus, for example, if handle 110A is rotated in a clockwise direction, handle 110B is moved in a counter-clockwise rotation. In certain embodiments, the handles 110A and 110B may be moved in opposite directions simultaneously or substantially simultaneously. In certain embodiments, the handles 110A and 110B are coated with a gripping material 111A and 111B (FIG. 1B) such as, for example, rubber or other elastomeric materials, leather, shrink tubing and the like, that allows a user to more easily grip the handles 110A and 110B while also providing a comfortable grip for the user.

As shown in FIG. 1B, the centerpiece 120 includes a male portion 120A and female portion 120B. The centerpiece also includes one or more conical pieces 130 and a center conical piece. As the female portion 120B is moved toward the male portion 120A in response to a twisting motion, the conical pieces 130 are moved inward toward the center conical piece 140. As the conical pieces 130 are moved together and the space between the center conical piece 140 and the conical pieces 130 decreases, the amount of friction increases. As discussed above, as the amount of friction increases, a user may be required to exert more force. Once the user has reached the desired amount of friction or the female portion 120B has completely mated with the male portion 120A, the user may rotate the handles in the opposite direction to decrease the friction and the process may be repeated.

As shown in FIG. 1B, the wrist strengthening device 100 may also include end caps 150. In certain embodiments, the end caps may be used to add weights or other attachments to one or both ends of the wrist strengthening device 100. In embodiments, the weights may include any material that adds additional weight to the device including lead, sand, water filled apparatus etc. In certain embodiments, each of the end caps 150 may have one or more orifices (threaded or non-threaded) that may be used to secure one or more weights to the wrist strengthening device 100. If weights are added in such a manner, the user may grip one of the handles of the wrist strengthening device 100 and, using a casting motion, perform additional wrist strengthening exercises for a single wrist.

For example, if weights are added to one of the end caps 140, a user may hold the wrist strengthening device 100 in an upright position (with the added weights on a distal end of the wrist strengthening device 100) and use a casting motion (e.g., moving the distal end of the wrist strengthening device from a first position near the body to a second position away from the body) to exercise the wrist. The added weights cause the user to exert more force as the user performs the casting motion.

In an embodiment, the wrist strengthening device 100 may also include a spacer 160 and a rod 170. In certain embodiments, the spacer 160 is used to keep the ends of the handles 110A and 110B from rubbing against each as a result of the twisting motion. Likewise, the rod 170 is used maintain the structure of the wrist strengthening device 100.

Figure 2A:
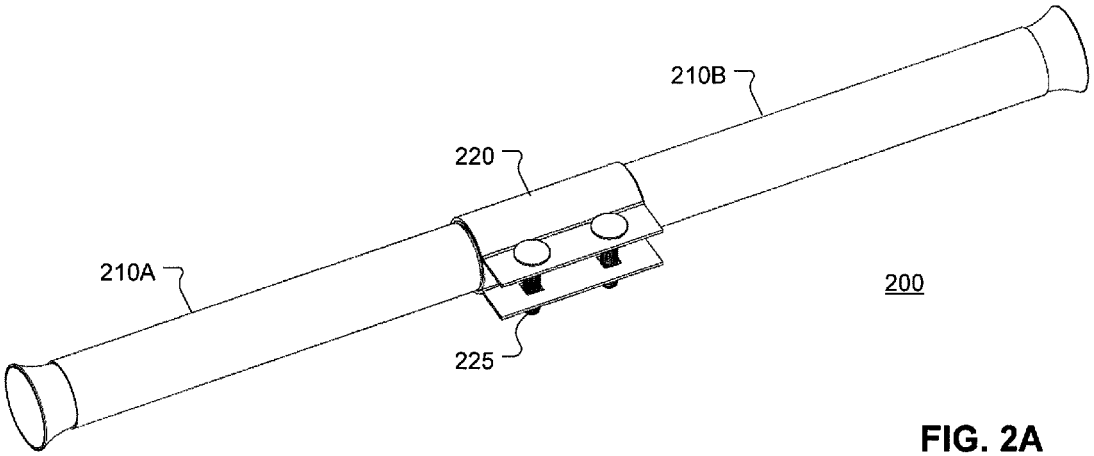
FIGS. 2A-2B illustrate a wrist strengthening device according to a second embodiment of the present disclosure.
Figure 2B:
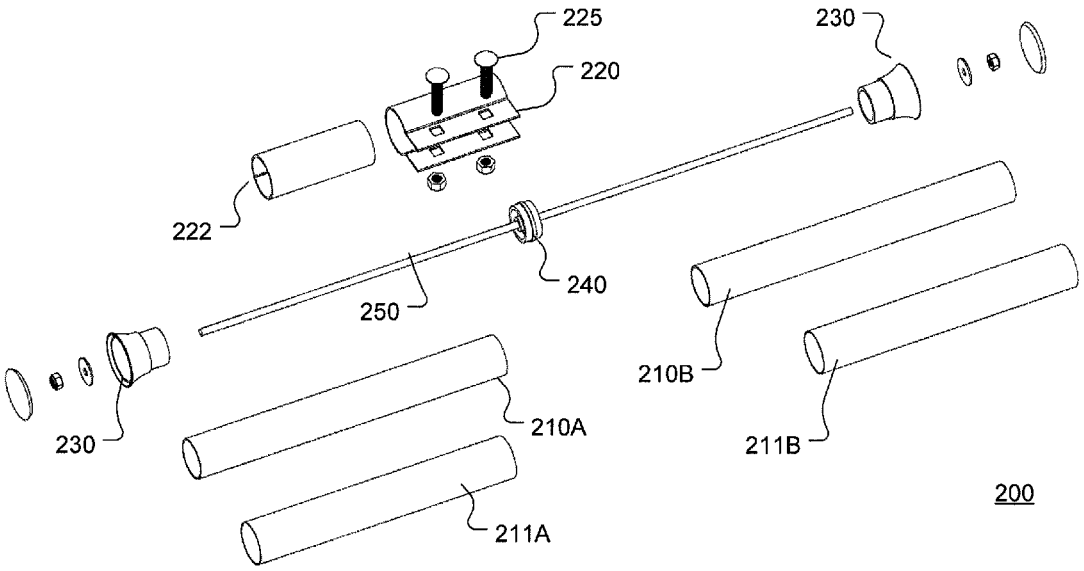

FIGS. 2A-2B illustrate a wrist strengthening device 200 according to a second embodiment of the present disclosure. Specifically, FIG. 2A illustrates an isometric view of the wrist strengthening device 200 and FIG. 2B illustrates an exploded isometric view of the wrist strengthening device 200. As with the wrist strengthening device 100 (FIG. 1A), the wrist strengthening device 200 is entirely springless and relies on friction to strengthen a user's wrists and/or forearms.

In certain embodiments, the wrist strengthening device 200 includes two handles 210A and 210B which are joined together via a centerpiece 220. As with the wrist strengthening device 100, each of the handles 210A and 210B of the wrist strengthening device 200 are configured to rotate in opposite directions. Additionally, the handles 210A and 210B may be covered with a gripping material 211A and 211B (FIG. 2B) such as an elastomeric material, leather, shrink tubing and the like.

In certain embodiments, the centerpiece 220 is a clamping mechanism that may be tightened or loosened by a user using a tightening mechanism 225. Although two tightening mechanisms 225 are shown, it is contemplated that any number of tightening mechanisms 225 may be used. As the tightening mechanism 225 is tightened, the centerpiece 220 closes around at least a portion of each the handles 210A and 210B which increases the friction between the handles 210A and 210B and the centerpiece 220. As a result, the user is required to exert more force in the twisting motion used to rotate the handles 210A and 210B.

FIG. 2B, illustrates an exploded isometric view of the wrist strengthening device 200. As shown in FIG. 2B, the centerpiece 220 may include a sleeve 222 that may be used to both protect the handles 210A and 210B as well as to assist in increasing the friction between the handles 210A and 210B and the centerpiece 220.

In certain embodiments, the wrist strengthening device 200 may also include end caps 230 that may be used to add weights or other attachments to the wrist strengthening device 200 such as was described above. Additionally, the wrist strengthening device 200 may include a spacer 240 and a rod 250 that are used to keep the ends of the handles 210A and 210B from rubbing against each other and to maintain the structure of the wrist strengthening device 200.

Figure 3A:
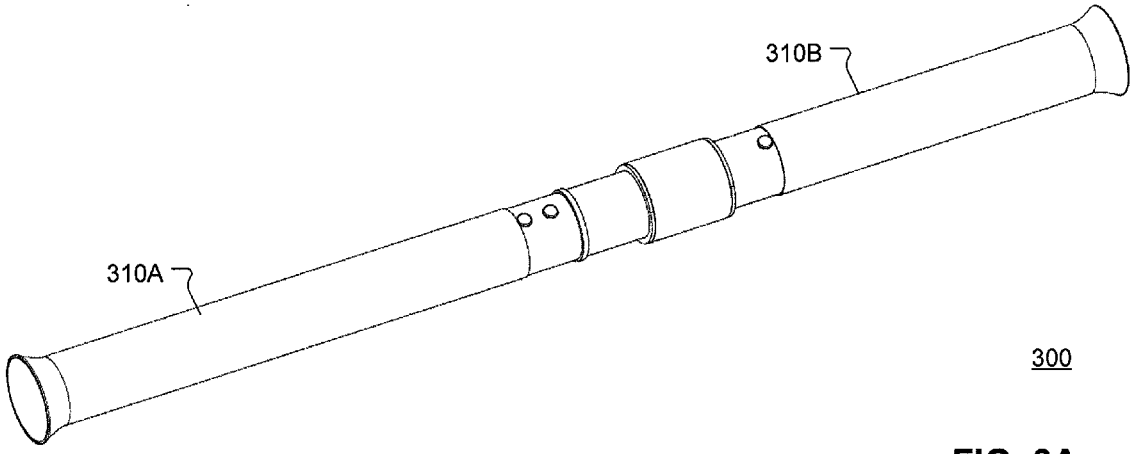
FIGS. 3A-3B illustrate a wrist strengthening device according to a third embodiment of the present disclosure.
Figure 3B:
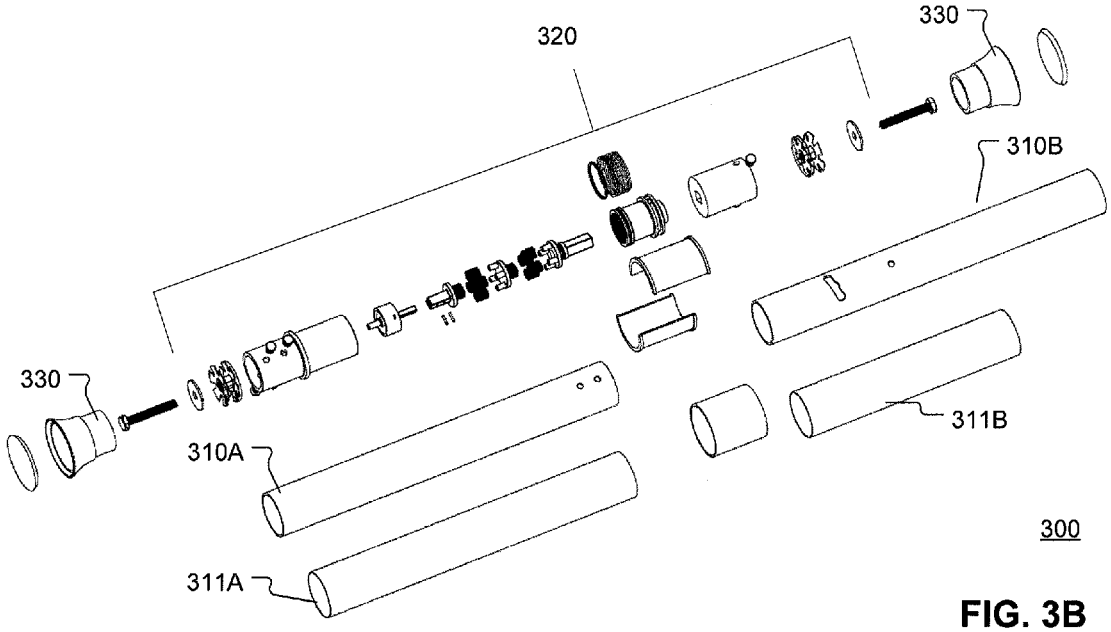

FIGS. 3A-3B illustrate a wrist strengthening device 300 according to a third embodiment of the present disclosure. Specifically, FIG. 3A illustrates an isometric view of the wrist strengthening device 300 and FIG. 3B illustrates an exploded isometric view of the wrist strengthening device 300. As with the wrist strengthening device 100 (FIG. 1A) and the wrist strengthening device 200 (FIG. 2A), the wrist strengthening device 300 is entirely springless. However, wrist strengthening device 300 utilizes a planetary gearbox 320 (FIG. 3B) to move hydraulic oil or other such substance from a first position to a second position. For example, the planetary gearbox 320 may include a plurality of chambers. As the handles are rotated, the liquid moves from a first chamber to a second chamber. In certain embodiments, the liquid may be required to pass through an opening between the chambers. Additionally, the opening between the chambers may be adjustable by a user.

As shown in FIG. 3A, the wrist strengthening device 300 includes two handles 310A and 310B which are coupled together. In certain embodiments, the handles 310A and 310B are coupled together using various rivets of the planetary gearbox 320. As was briefly described above, as a user twists each of the handles 310A and 310B of the wrist strengthening device 300, the twisting motion causes the gears of the planetary gearbox 320 to rotate which in turn drives an impeller which causes the hydraulic oil to move. Movement of the oil creates resistance to rotation of the handles which in turn, strengthens a user's wrists and/or forearms as the user continues to exert a force for the twisting motion. In certain embodiments, a user may be able to adjust the size of a hole through which the liquid travels to increase and/or decrease the resistance of the twisting motion.

FIG. 3B, illustrates an exploded isometric view of the wrist strengthening device 300 including the various components of the planetary gearbox 320. As also shown in FIG. 3B, the handles 310A and 310B of the wrist strengthening device 300 may be covered with a gripping material 311A and 311B such as an elastomeric material, leather, shrink tubing and the like. The wrist strengthening device 300 may also include end caps 330 that may be used to add weights or other attachments such as was described above.

Figure 4A:
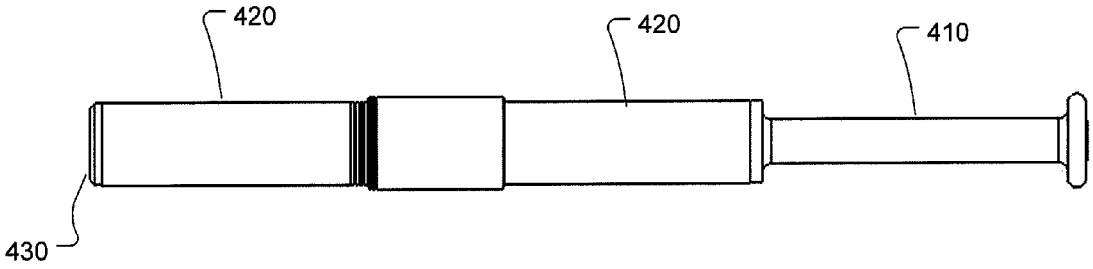
FIGS. 4A-4C illustrate a wrist strengthening device according to a fourth embodiment of the present disclosure.
Figure 4B:
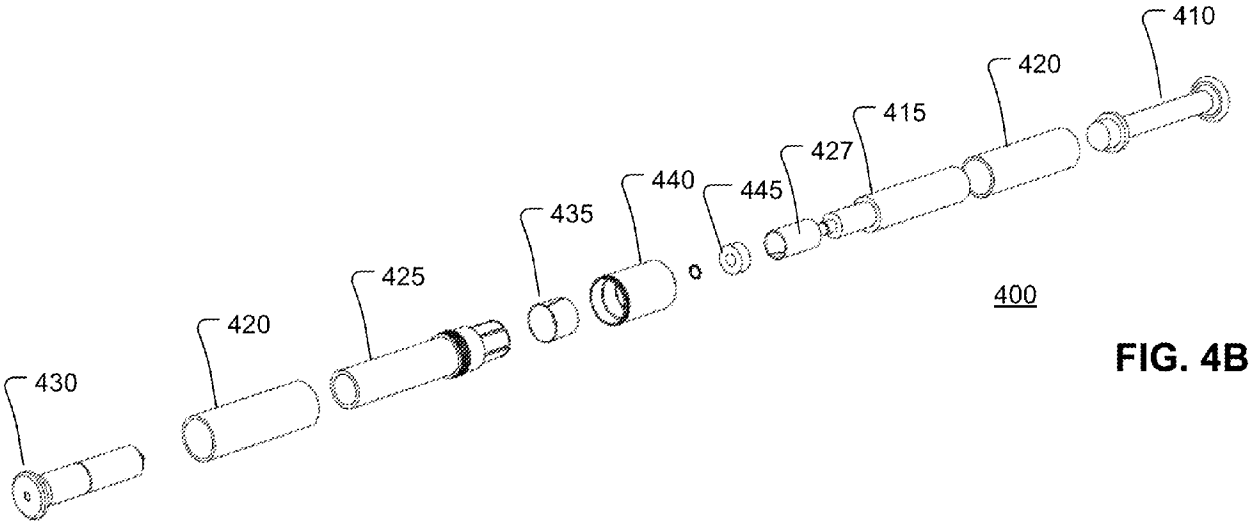

FIGS. 4A-4B illustrate a wrist strengthening device 400 according to a fourth embodiment of the present disclosure. Specifically, FIG. 4A illustrates a wrist strengthening device 400 that includes a handle 410. In embodiments shown, the handle 410 is in the shape of a baseball bat. However, it is contemplated that handles from various sporting equipment types may be used, such as, for example, a tennis racket handle, lacrosse stick handle, hockey stick handle, golf club handle and the like. In certain embodiments, the handle 410 is removable such that the various handles from the different sporting equipment may be interchanged. It is also contemplated that the handle 410 for each piece of sporting equipment is equivalent to one or more standard sizes of the sporting equipment. For example, a baseball bat handle for a youth size may be ⅞", a small size may be 15⁄16", a medium size may be 31⁄32", and a large size may be 1" or greater. In certain embodiments, the length of the handles is approximately 6.5" and the length of the device 400 is approximately 21". Although specific widths and lengths have been mentioned, it is contemplated that other widths and lengths in various combinations may be used. Additionally, as discussed above, various sizes may be used for each respective piece of sporting equipment handle. It is also contemplated that the handle may be coated with or include one or more gripping materials or gripping agents. As the handle 410 is equivalent in size to an actual piece of sporting equipment, a user training with the device 400 may feel like they are training with an actual piece of sporting equipment.

Device 400 also includes grips 420 on opposing ends of the device 400. In certain embodiments where the handle 410 is removable, the device may be used as a wrist strengthening device such as described above with respect to FIGS. 1A-3B. That is, a user may grip each of the grips 420 and rotate each of the handles around an axis of the device 400 such as described above. Additionally, each of the embodiments described above may be configured to receive a removable handle such as handle 410.

In certain embodiments, the device 400 may also include one or more weights 430 that may be inserted and removed from a top portion of the device 400. The weights may be configured in various shapes, weight and sizes and fit either into or on top of various portions of the device 400.

FIG. 4B illustrates an exploded isometric view of the device 400 according to embodiments of the present disclosure. As discussed, device 400 may include a handle 410. In certain embodiments the handle 410 is removably attached to an inner insert portion 415 of the device 400. In embodiments a grip 420 comprised of a gripping material (e.g., rubber) is overlaid on the inner insert portion 415 to provide extra grip to a user.

Figure 4C:
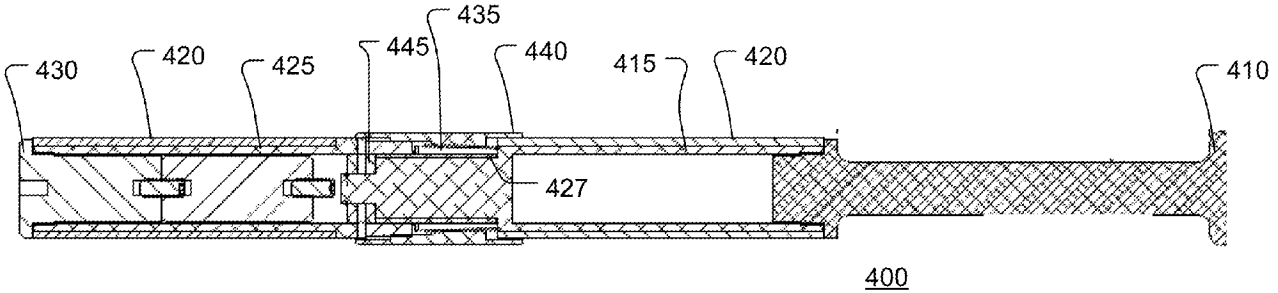

The device 400 also includes a clamp insert 425 that is configured to be coupled with a handle bearing 427 of the inner insert 415. In certain embodiments, When connected, a lock bearing 435 is coupled to the handle bearing 427 and the inner insert 415 which, when tightened, provides resistance to the clamp insert 425. A collar 440 provides a mechanism whereby a user can tighten and loosen the clamp insert 425 to provide more or less resistance to a twisting motion that causes the handles to rotate around an axis of the device 400. As shown, a retainer bearing 445 may be used to hold each of the above identified portions in place when the device 400 is assembled. FIG. 4C illustrates a cross-sectional view of the device 400 when each of the components described above have been assembled.

Figure 5A:
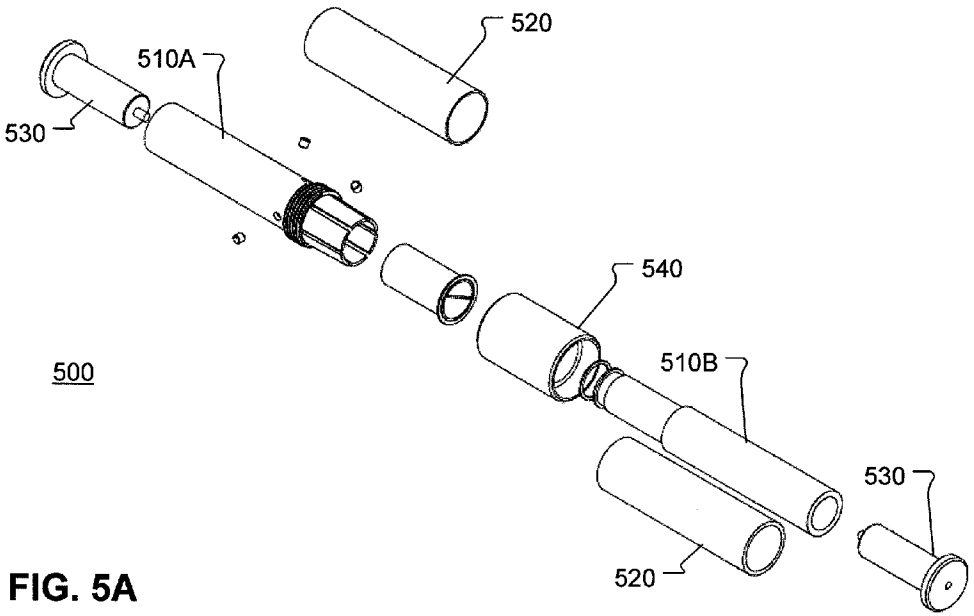
FIGS. 5A-5B illustrate a wrist strengthening device according to a fifth embodiment of the present disclosure.
Figure 5B:
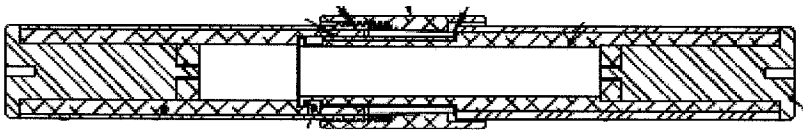

FIGS. 5A-5B illustrate a wrist strengthening device 500 according to a fifth embodiment of the present disclosure. As shown in FIG. 5A, the wrist strengthening device 500 includes handle tubing 510A and 510B. In embodiments, the handle tubing 510A and 510B may be hollow or partially hollow to enable the insertion of one or more weights 530 in an open end of the handling tubing 510A and 510B. One or more screws may be used to hold the weights in place. In another embodiment, the weights, or portions thereof, may have one or more connection means (threads, magnets, clips, snaps and the like) whereby the weights may be stabilized within the handle tubing 510A and 510B. As also shown, at least one handle tubing 510A has a series of threads on which a tension ring 540 may be placed. In embodiments, the tension ring 530 may be used to increase tension of the wrist strengthening device 500. The wrist strengthening device 500 may also have gripping material 520 coupled to each of the handle tubing 510A and 510B. As also shown in FIG. 5A, one or more bearings may be used to ensure the handle tubing 510A and 510B are able to rotate about their respective axis when a twisting motion is used by a user.

As with other embodiments described herein, one or more handles (i.e., sporting equipment handles) may be removably coupled to the wrist strengthening device 500. In other embodiments, other attachment mechanisms may be attached such as, for example, additional weights. FIG. 5B illustrates a cross-sectional view of the wrist strengthening device 500 when each of the components described above have been assembled.

The description and illustration of one or more embodiments provided in this application are not intended to limit or restrict the scope of the claims in any way. However, one skilled in the relevant art may recognize that the embodiments may be practiced without one or more of the specific details, or with other resources, materials, etc. The embodiments, examples, and details provided in this application are considered sufficient to convey possession and enable others to make and use the best mode of the claimed subject matter. The claimed subject matter should not be construed as being limited to any embodiment, example, or detail provided in this application. Regardless of whether shown and described in combination or separately, the various features are intended to be selectively included or omitted to produce an embodiment with a particular set of features. Having been provided with the description and illustration of the present application, one skilled in the art may envision variations, modifications, and alternate embodiments falling within the spirit of the broader aspects of the general inventive concept embodied in this application that do not depart from the broader scope of the claims.

What is claimed is:

1. A wrist strengthening device, comprising:

a first handle;

a second handle coupled to the first handle; and a tightening component coupled to the first handle and the second handle, the tightening component comprising:

a clamp insert having a conical component adapted to apply pressure to an inner insert, and a collar, surrounding the clamp insert, adapted to tighten and loosen the conical component against the inner insert such that tightening the collar effects inward radial pressure from the conical component to the inner insert and loosening the collar relieves the inward radial pressure;

wherein the tightening component is adapted to provide resistance to axial movement of the first handle and the second handle as the first handle is moved in a first direction and as the second handle is moved in a second direction, opposite from the first direction the tightening component further comprising a lock bearing located between the collar and the conical component, a handle bearing located between the conical component and the inner insert, and a retainer bearing adapted to hold the clamp insert, handle bearing, inner insert, and collar in place when the wrist strengthening device is assembled.

2. The wrist strengthening device of claim 1, wherein at least one of the first handle or the second handle includes an opening on a distal end, and wherein the opening is configured to receive one or more weights.

3. The wrist strengthening device of claim 1, further comprising a detachable handle, wherein the detachable handle is adapted to be received in at least one of the first handle or the second handle.

4. The wrist strengthening device of claim 3, wherein the detachable handle is a replica of a handle of a golf club, baseball bat, tennis racket, lacrosse stick, or hockey stick.

5. The wrist strengthening device of claim 1, wherein the first handle and the second handle comprise a gripping material covering the inner insert; wherein at least a portion of the collar covers the gripping material.

6. The wrist strengthening device of claim 1, wherein the wrist strengthening device is adapted to be used in a casting motion.

7. The wrist strengthening device of claim 1, wherein the first handle is adapted to be moved simultaneously with the second handle.

8. The wrist strengthening device of claim 1, wherein the clamp insert is coupled with the first handle, and the inner insert is coupled with the second handle; and wherein the collar is located between the first handle and second handle.

* * * * *